United States Patent [19]

Carter, Jr.

[11] Patent Number: 4,474,380

[45] Date of Patent: Oct. 2, 1984

[54] INFLATABLE PACKER ASSEMBLY WITH CONTROL VALVE

[75] Inventor: Ernest E. Carter, Jr., Duncan, Okla.

[73] Assignee: Halliburton Company, Duncan, Okla.

[21] Appl. No.: 433,564

[22] Filed: Oct. 8, 1982

[51] Int. Cl.[3] ..... E21B 33/12

[52] U.S. Cl. ..... 277/34.6; 137/68 R

[58] Field of Search ..... 277/34, 34.3, 34.6; 137/68, 70, 456, 461, 463; 166/187

[56] References Cited

U.S. PATENT DOCUMENTS

| | | | |
|---|---|---|---|
| 3,107,725 | 10/1963 | Flickinger | 277/34.6 |
| 3,437,142 | 4/1969 | Conover | 277/34 |
| 4,260,164 | 4/1981 | Baker et al. | 277/34 |

*Primary Examiner*—Robert I. Smith

*Attorney, Agent, or Firm*—Thomas R. Weaver; James R. Duzan

[57] ABSTRACT

An inflatable packer assembly includes a cylindrical mandrel with a cylindrical valve body concentrically disposed about the mandrel. The valve body includes an inlet communicating with an interior of the mandrel and an outlet for directing fluid to an inflatable element of the packer assembly. First and second axial bores, containing first and second pistons, respectively, are disposed in said valve body and communicate with an end surface thereof. The first bore also communicates with said inlet. A first port connects the first and second bores. A second port connects the second bore and the outlet. The first piston which includes a check valve is held in a first position blocking said first port until a pressure differential across the first piston reaches a first level at which the first piston is released and is moved to a second position allowing fluid communication between the inlet and the first port. The second piston is held in a first position allowing fluid communication between said first and second ports until a pressure differential across said second piston which senses the packer element inflation pressure reaches a second level, higher than said first level, at which said second piston is released and is moved to a second position blocking said second port. At this time the check valve of the first piston is actuated blocking said first port. A check valve disposed about the packer mandrel also prevents fluid flow from said inflated packer element.

14 Claims, 6 Drawing Figures

INFLATABLE PACKER ASSEMBLY WITH CONTROL VALVE

This invention relates generally to an improved inflatable packer assembly for use with a casing or other tubular member of a well, and more particularly, but not by way of limitation to a control valve for use with such a packer assembly or other downhole tool. More particularly an improved inflatable packer of the type shown in U.S. Pat. No. 4,253,676, issued Mar. 3, 1981 to Baker et al and assigned to the assignee of the present invention.

An inflatable packer is a downhole tool which can be inflated with well fluid to seal off the annular space between, for example, the casing and the wellbore. It may also be used inside a casing.

Inflatable packers may be used in a well for a variety of reasons. They can be used to support a column of cement above a lost circulation zone. They can be used to isolate producing zones from cementing operations. Also, they may be used to isolate production and lost circulation zones for gravel pack operations.

Typical prior art control valves for inflatable packers have included both spring loaded check valves, and various forms of sliding sleeve valves, for controlling the flow of well fluid to the inflatable element to inflate the same.

Examples of spring loaded check valves are disclosed in U.S. Pat. No. 3,437,142 to Conover, U.S. Pat. No. 3,085,628 to Malone, and U.S. Pat. No. 2,177,601 to Smith. Examples of sliding sleeve valves are disclosed in U.S. Pat. No. 3,524,503 to Baker and U.S. Pat. No. 3,053,322 to Kline.

The present invention provides an improved inflatable packer assembly having a check valve located on a cylindrical mandrel about which the packer element is disposed and a cylindrical valve body having a check valve therein concentrically disposed about the mandrel. The valve body includes an inlet communicating with an interior of the mandrel and an outlet means for directing fluid to an inflatable element of the packer assembly. First and second axial bores, containing a check valve and first piston and a second piston, respectively, are disposed in said valve body and communicate with an end surface thereof. The first bore also communicates with said inlet. A first port means connects the first and second bore means. A second port means connects the second bore means and the outlet. The check valve and first piston is held in a first position blocking said first port means until a pressure differential across the first piston reaches a first level at which the first piston is released and the check valve and piston are moved to a second position allowing fluid communication between the inlet and the first port means. The second piston is held in a first position allowing fluid communication between said first and second port means until a pressure differential across said second piston reaches a second level, higher than said first level, at which said second piston is released and is moved to a second position blocking said second port means.

When the second piston is released to block the second port means, the check valve moves to block flow from the first port means. To control fluid flow from the annular space between the packer element and cylindrical mandrel, an annular check valve located about the cylindrical mandrel is utilized. Also, if there is any decrease in fluid pressure while the packer is inflating but before the second piston is released to block the second port means either the check valve disposed about the packer mandrel or the check valve disposed in the valve body will present fluid flow from the packer.

In contrast to the type valve shown in U.S. Pat. No. 4,253,676, issued Mar. b 3, 1981 and assigned to the assignee of the present invention, which may require excessive pressurization of the casing to insure the locking in of inflation pressure of the packer because there is no surface indication that the inflation pressure of the packer has been locked in, the valve and packer design of the present invention eliminates the need of excessive pressurization of the casing by including either a check valve on the packer mandrel or a check valve in the valve body of the packer or both to prevent any fluid flow from the packer if the second piston has not locked in the inflation pressure of the packer.

The valve of the present invention also includes a second valve having replaceable shear pins so that the second valve may be tested before use and has the second valve ported to sense shutoff pressure from the packer element side of the closing valve to help prevent premature shutoff of the inflation fluid to the packer.

The valve of the present invention further includes a piston type check valve which is integral with the first or primary piston that also includes replaceable shear pins so that the first or primary valve may be pressure tested before use.

Additionally, the valve assembly of the present invention is constructed as an independent unit which can be pressure tested as an independent assembly prior to assembly with the inflatable packer assembly.

FIGS. 1A and 1B is a schematic partly sectional elevation illustration of the inflatable packer assembly with control valve of the present invention in place within an oil well borehole.

FIGS. 2A and 2B comprise an enlarged sectional elevation view of the inflatable packer assembly with control valve of FIG. 1.

Figure 1A:
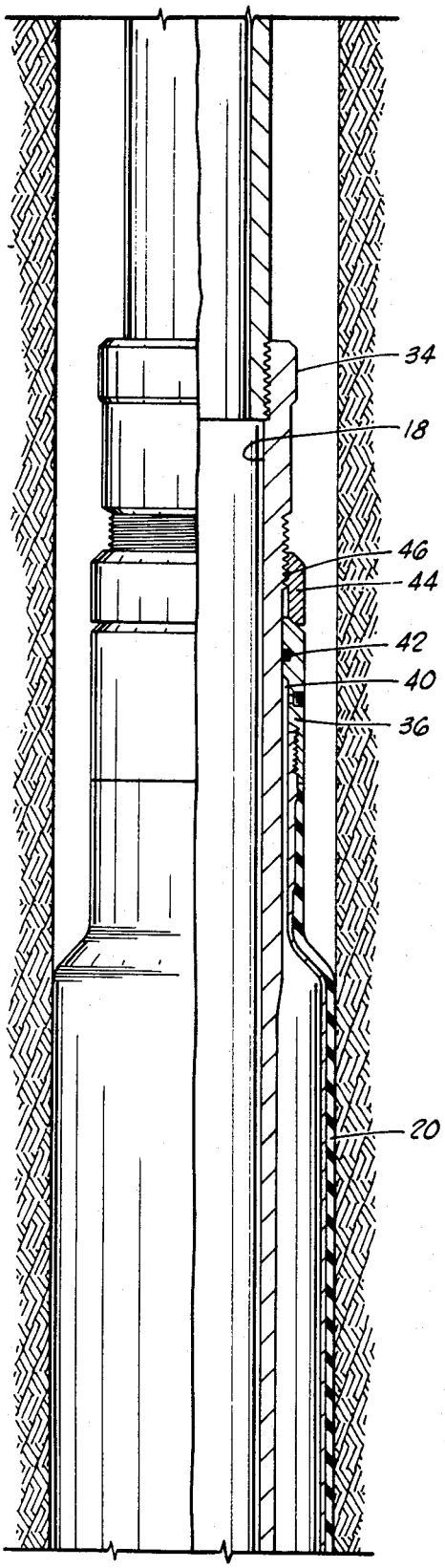
Figure 1B:
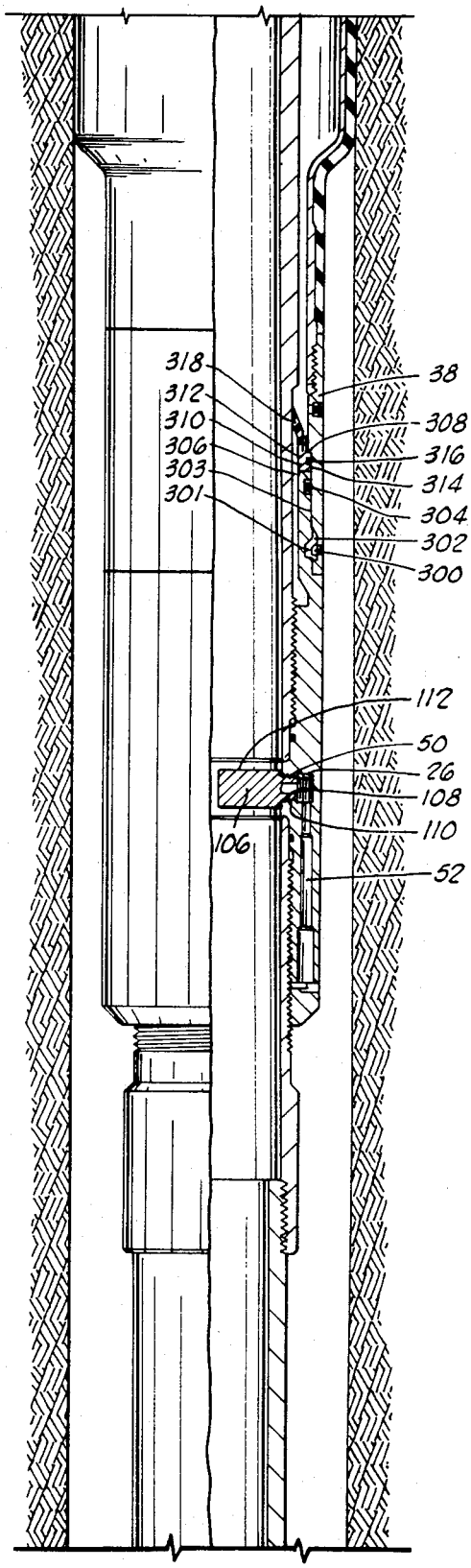

Referring now to the drawings, and particularly to FIG. 1, the inflatable packer assembly of the present invention is shown and generally designated by the numeral 10. The inflatable packer assembly 10, which may more generally be referred to as a downhole tool, is generally connected as an integral part of a casing string 12, which may generally be referred to as a tubular member. The casing string 12 is disposed in a borehole or well hole 14 of an oil well so that there is an annular cavity or space 16 between casing string 12 and well hole 14. It will be understood by those skilled in the art, that the present invention could be equally well applied to a downhole tool connected to a liner string located within a well hole defined by an inner surface of a well casing.

The inflatable packer assembly 10 includes a cylindrical mandrel 18 having an inflatable element which may be referred to as a bladder means or packer 20 connected to the mandrel 18 for sealing said annular cavity 16. The bladder means 20 and the mandrel 18 define an annular fluid-filled space 22 therebetween when said bladder means 20 is inflated to seal said cavity 16.

A valve means generally designated by the numeral 24 includes an inlet 26 communicating with an interior of tubular member 12 through an interior 28 of said mandrel 18, and an outlet 30 communicating with said annular space 22. The valve means 24 communicates with said interior 28 of said mandrel 18 with said annular space 22 when a fluid pressure differential between said interior 28 of said mandrel 18 and said cavity 16 adjacent a lower end 54 of said valve means 24 reaches a first predetermined level, so that fluid from said interior 28 flows into said annular space 22 to inflate said bladder means 20 as illustrated in FIG. 1.

The valve means 24 also includes a means for isolating said interior 28 from said annular space 22 when said pressure differential reaches a second level higher than said first level, while preventing any loss of fluid from said annular space 22 as said interior 28 is being isolated therefrom.

A check valve is further shown to control the flow of fluid from the interior of packer element 22.

Figure 2A:
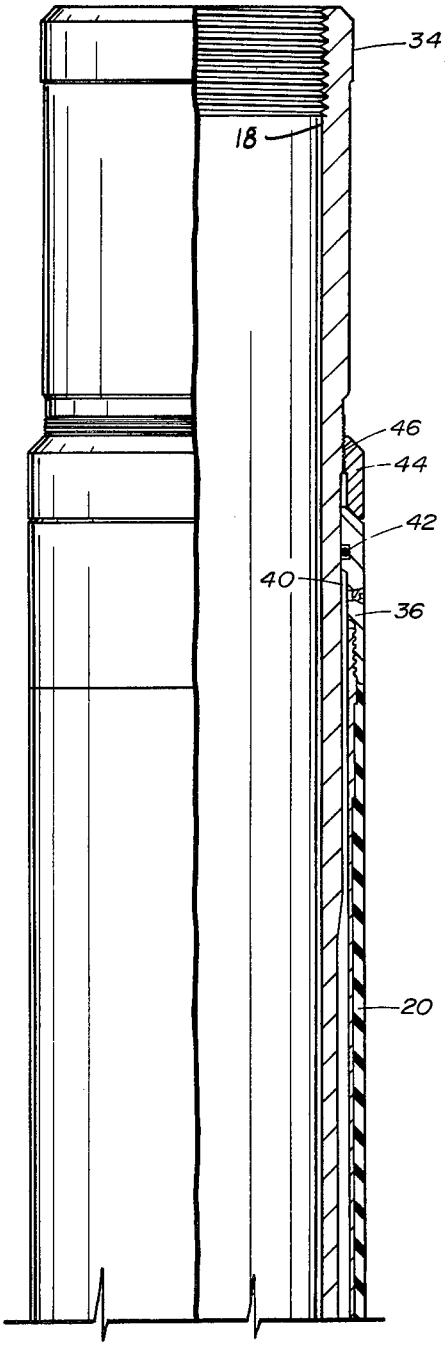
Figure 2B:
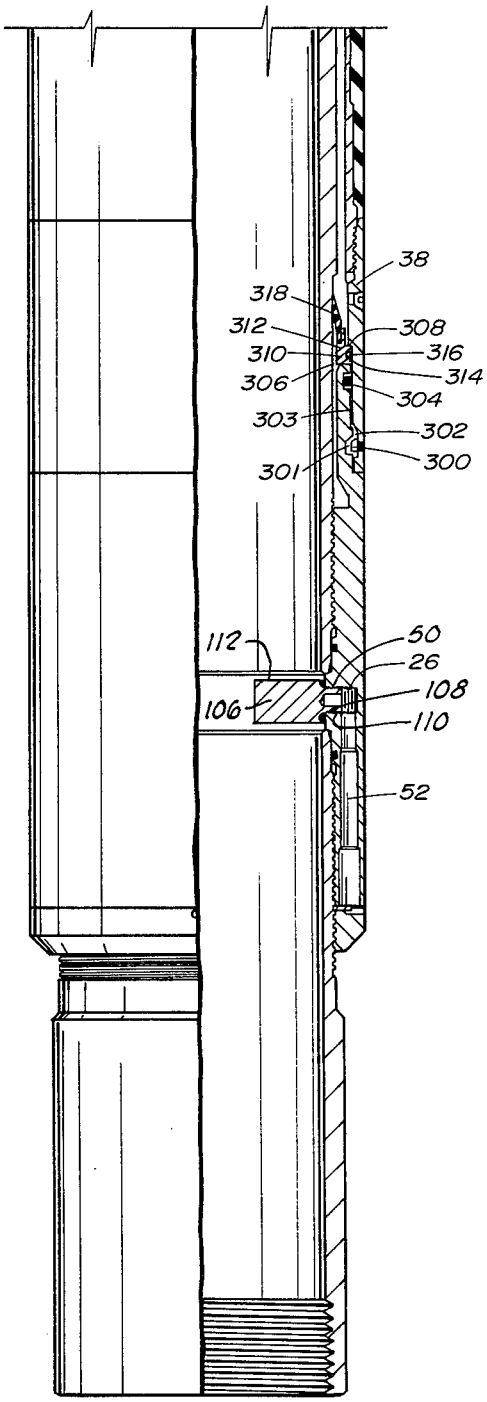

Referring now to FIGS. 2A and 2B, the inflatable packer assembly 10 includes an upper body 32 threadedly connected to an upper end 34 of mandrel 18 for connecting mandrel 18 to the casing string 12.

The inflatable packer element 20 is connected at its upper and lower ends to upper and lower packer shoes 36 and 38, respectively.

Upper packer shoe 36 sealingly engages an outer cylindrical surface 40 of mandrel 18 with an elastomeric O-ring 42. When inflatable packer element 20 is in the uninflated position shown in FIG. 2 the upper packer shoe 36 abuts an upper backup ring 44. Upper backup ring 44 is secured to outer cylindrical surface 40 of mandrel 18 by threaded engagement as indicated at 46.

The lower packer shoe 38 is releasably secured to the valve means 24 by annular lock ring 300 which is retained within annular cavity 301 of the valve means 24 and annular cavity 202 of the lower packer shoe 38. Bore 304 of lower packer shoe 38 sealingly engages exterior surface 303 of the valve means 24. Retained in annular cavity 306 which is formed betweeen the end of valve means 24 and annular shoulder 308 is annular check valve 310. The annular check valve 310 comprises annular check valve body member 312 and annular elastomeric check valve member 318 secured thereto having annular recess 314 therein having, in turn, annular elastomeric O-ring seal 316 therein which sealingly engages bore 304 of lower packer shoe 38 and having annular elastomeric seal lip 318 which sealingly engages the packer mandrel 18.

The lower packer shoe 38 is releasably secured to the valve means 24 by annular lock ring 300 which is retained within annular cavity 302 formed by valve means 24 includes a cylindrical valve body 48 concentrically disposed about outer surface 40 of mandrel 18. The cylindrical valve body 48 includes the inlet 26 which is permanently aligned with a hole 50 disposed through a wall of said mandrel 18 and communicating with said interior 28 of mandrel 18.

Valve body 24 also includes the outlet 30 for directing fluid from the interior 28 to the annular fluid-filled space 22 of bladder means 20. Bladder means 20 may also be referred to as a component of the downhole tool which is to be actuated by said fluid from the interior of mandrel 18.

Figure 3:
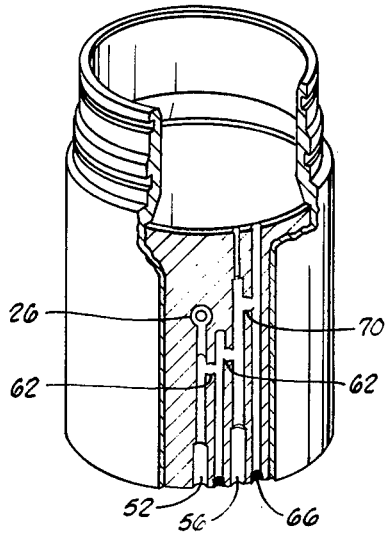
FIG. 3 is an isometric view of the control valve with a portion of the wall thereof removed to show only the piston bores and interconnecting ports.
Figure 4:
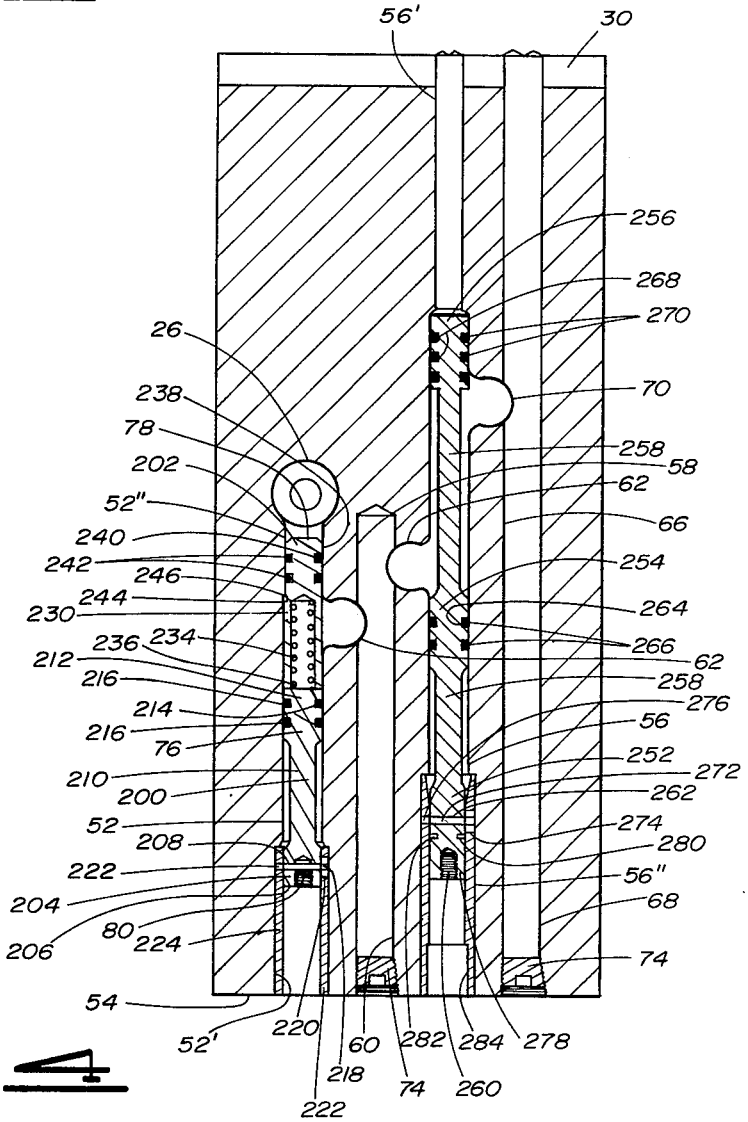
FIG. 4 is a schematic representation of the piston bores and ports of the valve of FIG. 3.

As is best seen in FIGS. 3 and 4, the valve body 48 further includes a first axial bore 52 connecting said inlet 26 with an end surface 54 of said cylindrical valve body 48. Valve body 48 also includes a second axial bore 56 communicating with said end 54 of valve body 48 and outlet 30 to the packer. End surface 54 communicates with the annular space 16 about outer cylindrical surface 40 of mandrel 18.

A first port means, generally designated by the numeral 58, interconnects said first and second bores 52 and 56. First port means 58 comprises a third axial bore 60 which is intersected by a crossbore 62. Crossbore 62 also intersects first and second axial bores 52 and 56.

A second port means, generally indicated by the numeral 66 interconnects second bore 56 with outlet 30. Second port means 66 comprises a fourth axial bore 68 connecting first end 54 of valve body 24 with outlet 30. Second port means 66 further comprises a second crossbore 70 intersecting second and fourth axial bores 56 and 68.

Those ends of third and fourth axial bores 60 and 68, and of first and second crossbores 62 and 70, which communicate with first end 54 of valve body 48 or with radially outer surface 72 of valve body 48 are sealed after being drilled, with pipe plugs 74 as shown in FIG. 4.

A first or primary piston 76 is slidably disposed in first bore 52. The first piston 76 comprises a first portion 200 and a second check valve portion 202. The first piston 76 has first and second ends 78 and 80, respectively, which are in fluid communication with said inlet 26 and said first end 54 of valve body 48, respectively.

The first portion 200 of the first piston 76 comprises a cylindrical member having a first end 204 having an axial threaded bore 206 therein and a transverse bore 208 therethrough, an interconnecting reduced diameter portion 210, and second end 212 having annular recesses 214 therein having, in turn, elastomeric members 216 therein which sealingly engage a portion of first axial bore 52.

The first portion 200 is initially retained within position in first axial bore 52 by a shear pin 218 which passes through transverse bore 208. The shear pin 218 has the ends thereof retained within hole or aperture 220 and bore 222 of annular cylindrical member 224 which is retained within enlarged portion 52' of the bore 52.

The second check valve portion 202 of the first piston 76 comprises a cylindrical piston 230 having a bore 232 in one end thereof having, in turn, a spring 234 retained therein which has one end 236 thereof engaging end surface of second end 212 of first portion 200 and having a reduced diameter other end portion 238 having, in turn, annular recesses 240 therein containing elastomeric members 242 therein sealingly engaging reduced diameter portion 52" of first bore 52. Annular shoulder 244 of the second check valve portion 202 engaged annular shoulder 246 of reduced diameter portion 52" of first axial bore 52 to limit axial movement of second portion 202 in one direction of the bore 52.

First piston 76 is movable between a first position, illustrated in FIG. 4, blocking said first port means 58 and a second position (having first 200 and second 202 portions displaced to the right from the position shown in FIG. 4 so as to having one end of first portion 200 abutting lower backup ring 134 and one end of second portion 202 abutting the other end of first portion 200) allowing fluid communication between said inlet 26 and said first port means 58. When first piston 76 is in said second position, the second portion 202 is displaced to the right past first crossbore 62, so that inlet 26 is communicated with first crossbore 62.

Referring to FIG. 2B the first piston 76 is thereshown in its first position. First piston or primary piston 76 is connected to valve body 48 by a shear pin 218 via cylindrical member 224. Shear pin 218 may be referred to as a means for holding first piston 76 in said first position until a fluid pressure differential between interior 28 of mandrel 18 and said first end 54 of valve body 48, i.e. annular space 16, reaches a first level, and for releasing first piston 76 so that it may be moved to said second position by said pressure differential when said differential reaches said first level.

First piston 76 includes a reduced diameter portion 210 between first and second ends 204 and 212 thereof. It is very difficult to manufacture a long bore of relatively small diameter, such as first bore 52, which is absolutely straight. The bore 52 generally will have some very slight curve or other irregularity from the desired straight line of bore. The reduced diameter portion 210 of first piston 76 gives piston 76 sufficient flexibility so that it may bend slightly to accomodate such irregularities in bore 52 when piston 76 is moving between its said first and second positions within bore 52. This provides an advantage over a constant diameter piston which would have more of a tendency to become stuck within an irregular bore.

A second piston 250 is slidably disposed in second axial bore 56. Second piston includes first end 252, middle portion 254 and second end 256 interconnected by reduced diameter portions 258.

The first end 252 comprises a cylindrical member having an axial threaded bore 260 therein and a transverse bore 262 therethrough.

The middle portion 254 comprises a cylindrical member having annular receses 264 therein having, in turn, elastomeric members 266 therein sealingly engaging bore 56.

The second end 256 comprises a cylindrical member having annular recesses 268 therein having, in turn, elastomeric members 270 therein sealingly engaging bore 56.

The second piston 250 is initially retained within position in second axial bore 56 by a shear pin 272 which passes through transverse bore 262 in first end 252. The shear pin 272 has the ends thereof retained within hole or aperture 274 and bore 276 of annular cylindrical member 278 which is retained within enlarged portion 56'' of bore 56.

The second end 256 is in fluid communication with first port means 58 and first end 252 is in fluid communication with said first end 54 of valve body 48 which communicates with annular space 16.

Second piston 250 is movable between a first position, illustrated in FIG. 4, allowing fluid communication between said first and second port means 58 and 66, respectively, and a second position (displaced to the right from that shown in FIG. 4 so as to block fluid flow to third crossbore 70) blocking said second port means 66.

Second piston 250 includes reduced diameter portions 258, so that when second piston 250 is in said first position said first and second port means 58 and 66 are communicated through said second bore 56 around said reduced diameter portions 258 of second piston 250.

Second piston 250 is connected to valve body 48, when in the first position illustrated in FIG. 4, by a shear pin 272 similar to shear pin 218. The shear pin connecting second piston 250 to valve body 48 may also be referred to as a means for holding said second piston 84 in said first position until said fluid pressure differential between said interior 28 and said first end 54 of valve body 48 reaches a second level, said second level being higher than said first level, and for releasing said second piston 250 so that it may be moved to its said second position by said pressure differential when said pressure differential reaches said second level.

Second piston 250 includes an outer annular groove 280 containing an expandable metal retaining ring 282. When second piston 250 is displaced to the right from the position shown in FIG. 4 to its second position, retaining ring 94 expands and engages a counterbore 284 of annular cylindrical member 278 which is concentric with second bore 56 and communicates with first end 54 of valve body 24. This locks second piston 84 into said second position, and permanently and automatically isolates interior 28 from the annular space 22 when the pressure differential reaches said second level.

As shown in FIG. 2B a removable knock-out plug 106 is engaged with and blocks hole 50 in the wall of mandrel 18. Knock-out plug 106 includes a tubular portion 108 having external threads 110 engaging said hole 50. Knock-out plug 106 also includes an extension 112 projecting radially into said interior 28 of mandrel 18. Knock-out plug 106 is constructed so that extension 112 may be broken or sheared off by a force from above.

The extension 112 is generally sheared off by pumping or dropping a cement plug down the interior of casing 12 and mandrel 18 or by running some other tool on a drill string down the casing 12 so as to strike knock-out plug 106 and shear off extension 112.

The knock-out plug 106 is so constructed that when extension 112 is sheared off it shears at a point within hole 50 so that there are no sharp edges projecting into interior 28 of mandrel 18 which might cut swab cups or the like being moved through casing 12.

When extension 112 is sheared off of knock-out plug 106 this allows fluid communication between interior 28 and the inlet 26 of valve body 48 through the tubular portion 50 of knock-out plug 106.

The valve means 24 is so constructed that it may be very easily assembled with the mandrel 18. The valve means includes the cylindrical valve body 48 having the first end 54 and a second end 114.

A constant diameter cylindrical inner surface 116 of valve body 48 innerconnects said first and second ends 54 and 114, respectively. The cylindrical outer surface 40 of mandrel 18 is closely received within said cylindrical inner surface 116 of valve body 48 and such cylindrical outer surface 40 of mandrel 18 extends past each of said first and second ends 54 and 114 of said valve body 48.

An upper portion of lower backup ring 134 is radially spaced from outer surface 40 of mandrel 18 so as to define an annular space 138 which communicates with first end 54 of valve body 48 and with first and second bores 52 and 56. A relief bore 140 communicates annular space 138 with the cavity 16 between mandrel 18 and borehole 14.

The operation of the inflatable packer assembly 10 is as follows. The inflatable packer assembly 10 is constructed and assembled as illustrated in FIGS. 1 and 4 with the first and second pistons 76 and 250 in their first positions with the shear pins in place. The inflatable packer assembly 10 is then attached as an integral part of casing 12 as illustrated in FIG. 1 and is lowered into the borehole 14 until the packer 20 is adjacent the location where it is desired to seal the cavity 16 between the casing 12 and the borehole 14.

To prevent premature inflation of the packer or bladder means 20 while running the casing 12 into the hole 14, the hole 50 and inlet 26 are blocked by the knock-out plug 106.

Once the casing is properly positioned and it is desired to inflate the packer 20, the extension 112 is sheared off of the knock-out plug 106 to allow fluid from interior 28 of the mandrel 18 to enter inlet 26.

In a preferred embodiment of the present invention, once the knock-out plug 106 is removed the first piston 76 will remain in its first position until a pressure differential across that first piston, i.e. a pressure differential between the interior 28 of mandrel 18 and the cavity 16, reaches a first predetermined level at which the shear pin 218 is designed to shear.

When the pressure differential reaches that first level the shear pin 218 shears and allows first piston 84 to move to its second position so that fluid may flow through first port means 58, second bore 56, and second port means 66 to outlet 30. The fluid flows through outlet 30, then through annular passage 126, and then through the narrow annular clearance 142, between lower packer shoe 38 and outer surface 40 of mandrel 18, to the annular space 22 between bladder means 20 and mandrel 18.

When the fluid under pressure from the interior 28 of mandrel 18 flows into the annular space 22 it inflates the bladder 20 from the uninflated position shown in FIGS. 2A and 2B to the inflated position shown in FIG. 1.

The annular space 22 will remain in fluid communication with the interior 28 of mandrel 18 until the pressure differential between the interior 28 and the cavity 16 reaches a second level at which the shear pin 272 of second piston 250 is designed to shear and allow the second piston 250 to move to its second permanently locked position. When second piston 250 is in its second position the second port means 66 is permanently isolated from the interior 28 of mandrel 18 so that the bladder means 20 remains permanently inflated. The second level, at which the shear pin of the second piston shears, is higher than said first level of said pressure differential.

Another important feature of the present invention is that should the fluid pressure at the second level fail to shear pin 272 thereby allowing second piston 250 to lock in the inflation fluid and pressure level desired to inflate the packer, either or both the annular check valve 310 or second check valve portion 202 of first piston 76 will trap the inflation fluid and inflation pressure in the packer. The annular check valve 310 traps inflation fluid and pressure by the annular elastomeric seal lip 318 of the valve 310 engaging the packer mandrel 28 or the second check valve portion 202 being moved to block the flow through port 62 by the spring 234 moving the second check valve portion 202 from engagement with the end of first portion 200 to a position where the annular shoulder 244 of the second check valve portion 202 engages annular shoulder 246 of reduced diameter portion 52" of first axial bore 52.

Another important feature of the present invention is that it overcomes the possible premature shutoff of the inflation fluid to the packer by having the second valve 250 sense shutoff pressure from the packer element side of the second valve 250 rather than from the inlet side of the second valve.

A further important feature of the present invention is that the first and second valves include replaceable shear pins so that the valves may be pressure tested before use to ensure their proper operation.

An additional important feature of the present invention is that the valve assembly of the present invention is constructed as an independent unit which can be pressure tested as an independent assembly prior to assembly with the inflatable packer assembly.

Another feature of the present invention is that independently actuated check valves are included in the inflatable packer assembly. If desired, one or both of the check valve assemblies may be utilized in the packer assembly.

Thus, the inflatable packer assembly of the present invention is well adapted to obtain the advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An inflatable packer assembly comprising:

cylindrical mandrel;

a packer disposed about an outer cylindrical surface of said mandrel, said packer including an inflatable element;

valve means connected to said packer for directing fluid under pressure to said packer to inflate said element, said valve means including a cylindrical valve body having first and second ends with a cylindrical inner surface connecting said first and second ends, said cylindrical outer surface of said mandrel being closely received within said cylindrical inner surface of said valve means and said cylindrical outer surface of said mandrel extending past each of said first and second ends of said valve means;

first check valve means located in said valve means for preventing the flow of fluid under pressure from said packer; and second annular check valve means disposed about said cylindrical mandrel and located between the inflatable element of said packer and said valve means.

2. Apparatus of claim 1, wherein:

said packer further includes an annular shoe connected to an end of said inflatable element; and said valve means further includes:

an inlet communicating with an interior of said mandrel;

an outlet disposed in one of said ends of said valve body, said one end of said valve body being connected to said annular shoe of said packer; and port means, disposed in said valve body, connecting said inlet and outlet.

3. Apparatus of claim 2 wherein said outlet of said valve means includes an annular axially extending groove disposed in said one end of said valve body, said groove defining radially inner and outer axially extending concentric tongues.

4. Apparatus of claim 3, wherein a portion of said annular shoe adjacent said one end of said valve body is radially spaced from said outer cylindrical surface of said mandrel, forming an annular passage between said shoe and said mandrel, said annular passage communicating with said annular groove of said outlet of said valve means.

5. Apparatus of claim 4, wherein:

said radially inner tongue of said one end of said valve body is welded to said radially outer surface of said mandrel; and said radially outer tongue of said one end of said valve body is welded to said annular shoe of said packer.

6. A control valve assembly for a downhole tool, said downhole tool being constructed for connection to a tubular member to be lowered into a well hole, comprising:

a mandrel;

a valve body having an inlet and outlet thereto connected to said mandrel, said valve body including:

an inlet means for communicating with an interior of said tubular member;

an outlet means, for directing fluid to a component of said downhole tool which is to be actuated by said fluid;

a first bore means, disposed in said valve body, for communicating said inlet with an annular space between said tubular member and said well hole;

a second bore means disposed in said valve body, for communicating with said annular space and the outlet of said valve body;

a first port means, connecting said first and second bore means; and a second port means, connecting said second bore means and said outlet;

a first piston disposed in said bore means, said first piston having first and second ends arranged for fluid communication with said inlet and said annular space, respectively, said first piston being movable between a first position blocking said first port means and a second position allowing fluid communication between said inlet and said first port means, said first piston including:

first portion comprising:

cylindrical member means having a first end having an axial threaded bore therein and a transverse bore therethrough, an interconnecting reduced diameter portion, and a second end having annular recess means therein having elastomeric seal means therein which sealingly engage a portion of the first axial bore; and a second check valve portion comprising:

cylindrical piston means having a bore in one end portion thereof having a spring means retained therein which has one end thereof engaging an end surface of the first portion of said first piston and a reduced diameter other end portion having annular recess means therein containing elastomeric seal means therein sealingly engaging a portion of the first axial bore;

means for holding said first piston in said first position until a fluid pressure differential between said interior of said tubular member and said annular space reaches a first predetermined level, and for releasing said first piston so that it may be moved to said second position by said pressure differential when said differential reaches said first level;

a second piston disposed in said second bore means, said second piston having first and second ends arranged for fluid communication with said first port means and said annular space, respectively, said second piston being movable between a first position allowing fluid communication between said first and second port means and a second position blocking said second port means; and means for holding said second piston in its said first position until said fluid pressure differential reaches a second predetermined level, said second level being higher than said first level, and for releasing said second piston so that it may be moved to its said second position by said pressure differential when said differential reaches said second level.

7. Apparatus of claim 6, wherein:

said valve body is further characterized as a cylindrical valve body having a first end surface for communicating with said annular space; and said first and second bore means include first and second axial bores, respectively, said axial bores communicating with said end surface of said valve body.

8. Apparatus of claim 7, wherein:

said cylindrical valve body is concentrically disposed about said mandrel; and said inlet of said cylindrical valve body is permanently aligned with a hole disposed through a wall of said mandrel.

9. Apparatus of claim 8, further comprising a removable means for blocking said hole in said wall of said mandrel.

10. Apparatus of claim 7, wherein said outlet of said valve body includes an annular axially extending groove communicating with a second end of said cylindrical valve body.

11. Apparatus of claim 7, wherein:

said cylindrical valve body further comprises a counterbore concentric with said second bore at said end surface of said valve body; and said second piston includes an expandable ring for engaging said counterbore and locking said second piston in its said second position.

12. Apparatus of claim 6, wherein:

said means for holding said first piston includes a first shear pin connecting said first piston to said valve body; and said means for holding said second piston includes a second shear pin connecting said second piston to said valve body.

13. Apparatus of claim 6, wherein said second piston includes a reduced diameter portion, so that when said second piston is in said first position said first and second port means are communicated through said second bore around said reduced diameter portion of said second piston.

14. Apparatus of claim 6, wherein said second piston includes a first bore communicating with said second port means and a second bore for communicating said first bore with said first port means when said second piston is in its said first position.

* * * * *

UNITED STATES PATENT AND TRADEMARK OFFICE

CERTIFICATE OF CORRECTION

PATENT NO. : 4,474,380

DATED : October 2, 1984

INVENTOR(S) : Ernest E. Carter, Jr.

It is certified that error appears in the above-identified patent and that said Letters Patent is hereby corrected as shown below:

In column 2, line 7, delete the date [Mar. b 3, 1981] and insert therefor --March 3, 1981--.
In column 8, line 26, insert the word --a-- before the words "cylindrical mandrel;"
In column 9, line 33, following the words "disposed in said" insert the word --first--.

Signed and Sealed this

*Fifth* Day of *March 1985*

[SEAL]

*Attest:*

DONALD J. QUIGG

*Attesting Officer* *Acting Commissioner of Patents and Trademarks*